US006112435A

United States Patent [19]

Collavo

[11] Patent Number: 6,112,435

[45] **Date of Patent: *Sep. 5, 2000**

[54] SPORTS BOOT

[75] Inventor: Andrea Collavo, Montebelluna, Italy

[73] Assignee: Lange International S.A., Fribourg, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/108,443

[22] Filed: Jul. 1, 1998

[30] Foreign Application Priority Data

Jul. 30, 1997 [CH] Switzerland ..... 1821/97

[51] Int. Cl.[7] ..... A43B 5/04

[52] U.S. Cl. ..... 36/117.1; 36/95; 36/115

[58] Field of Search ..... 36/95, 115, 117.1, 36/117.6, 118.2, 3 A, 3 R

[56] References Cited

U.S. PATENT DOCUMENTS 2,389,032 11/1945 Donnelly .
3,419,974 1/1969 Lange .
3,807,062 4/1974 Spier .
5,171,033 12/1992 Olson et al. .
5,411,278 5/1995 Wittmann .
5,528,841 6/1996 Pozzobon .
5,667,737 9/1997 Wittmann .

FOREIGN PATENT DOCUMENTS 2 077 184 10/1971 France .
2 671 947 7/1992 France .
20 05 900 9/1970 Germany .

*Primary Examiner*—Ted Kavanaugh
*Attorney, Agent, or Firm*—Bugnion S.A.; John Moetteli

[57] ABSTRACT

The sports boot has a plastic shell (1) and an inner boot (8), the shell having at least one zone (12) which is less rigid than the less of the shell. The less rigid zone is a relatively flexible zone located on the side of the shell corresponding to the outside and/or inside of the foot, so as to face the metatarsophalangeal joint of the foot.

2 Claims, 2 Drawing Sheets

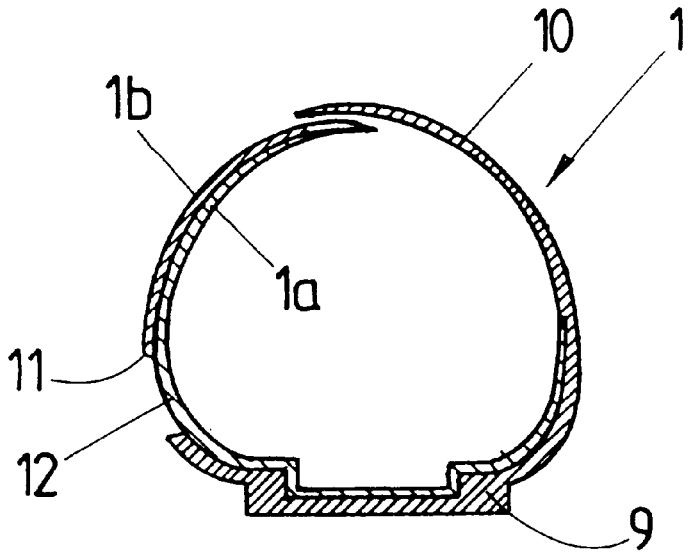
FIG. 2
Fig.3
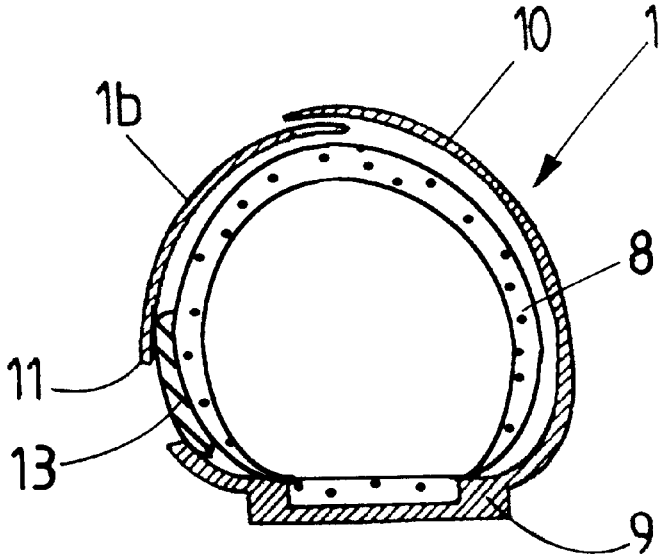

SPORTS BOOT

FIELD OF THE INVENTION

The present invention relates to a sports boot, in particular a boot for gliding sports such as ski or skate boot, having a plastic shell and an inner boot, said shell having at least one zone which is less rigid than the rest of the shell.

PRIOR ART

Ever since plastic ski boots, comprising a relatively rigid shell which provides good support for the foot, appeared on the market it has been common for skiers with wide feet to experience pain at the metatarsophalangeal joint, on the outside of the foot, this pain being due to compression of this zone by the shell of the boot. In order to alleviate this pain, special equipment has been developed to expand the shell by deformation in the sensitive zone. Yet to this day, in spite of the perfection of dual injection and the developments made by specialist manufacturers, no practical solution has been found for this problem.

It is admittedly true that Patent FR 2 077 184 proposed, for the first time, the manufacture, by dual injection, of a ski boot shell which has different degrees of flexibility in various regions of the upper, but the abovementioned problem has not been solved specifically and satisfactorily. This shell has a relatively flexible main part on which extra thicknesses of more rigid material are formed and relatively hard engagement zones are provided facing the metatarsophalangeal joint.

The technique of dual injection, that is to say successive injections into the same mold, is also used to manufacture the boot described in Patent FR 2 671 947.

Lastly, U.S. Pat. No. 5,888,228 and International Model DM/037 399 describe a ski boot shell having zones with different rigidity, the most rigid parts forming a kind of triangulated rigid frame whose purpose is to optimize the transmission of forces between the leg and the binding. This frame extends into the metatarsophalangeal region.

SUMMARY OF THE INVENTION

The object of the present invention is to provide a simple solution to the problem of pain being experienced at the metatarsophalangeal joint. In fact, if the population of individuals who have a given shoe size is considered, the width of the metatarsophalangeal joint will vary, as will its position relative to the heel.

The boot according to the invention is one wherein the less rigid zone is a relatively flexible zone on the side of the shell corresponding to the outside and/or inside of the foot, so as to face the metatarsophalangeal joint.

This zone may be small, but it must be flexible enough to deform readily sideways under the force exerted by the metatarsophalangeal joint, but without exerting painful pressure on this zone.

This less rigid zone is preferably obtained by injecting a flexible plastic into said zone, using a dual injection process.

The shell may, of course, have some other zones with lower rigidity.

BRIEF DESCRIPTION OF THE DRAWINGS

The appended drawing represents two embodiments of the invention by way of example.

FIG. 2 is a cross-sectional view on II—II in FIG. 1, without the buckle for closing and tightening.

FIG. 3 is a cross-sectional view on II—II in FIG. 1, without the buckle for closing and tightening, representing a second embodiment of the invention.

DESCRIPTION OF THE PREFERRED EMBODIMENTS

Figure 1:
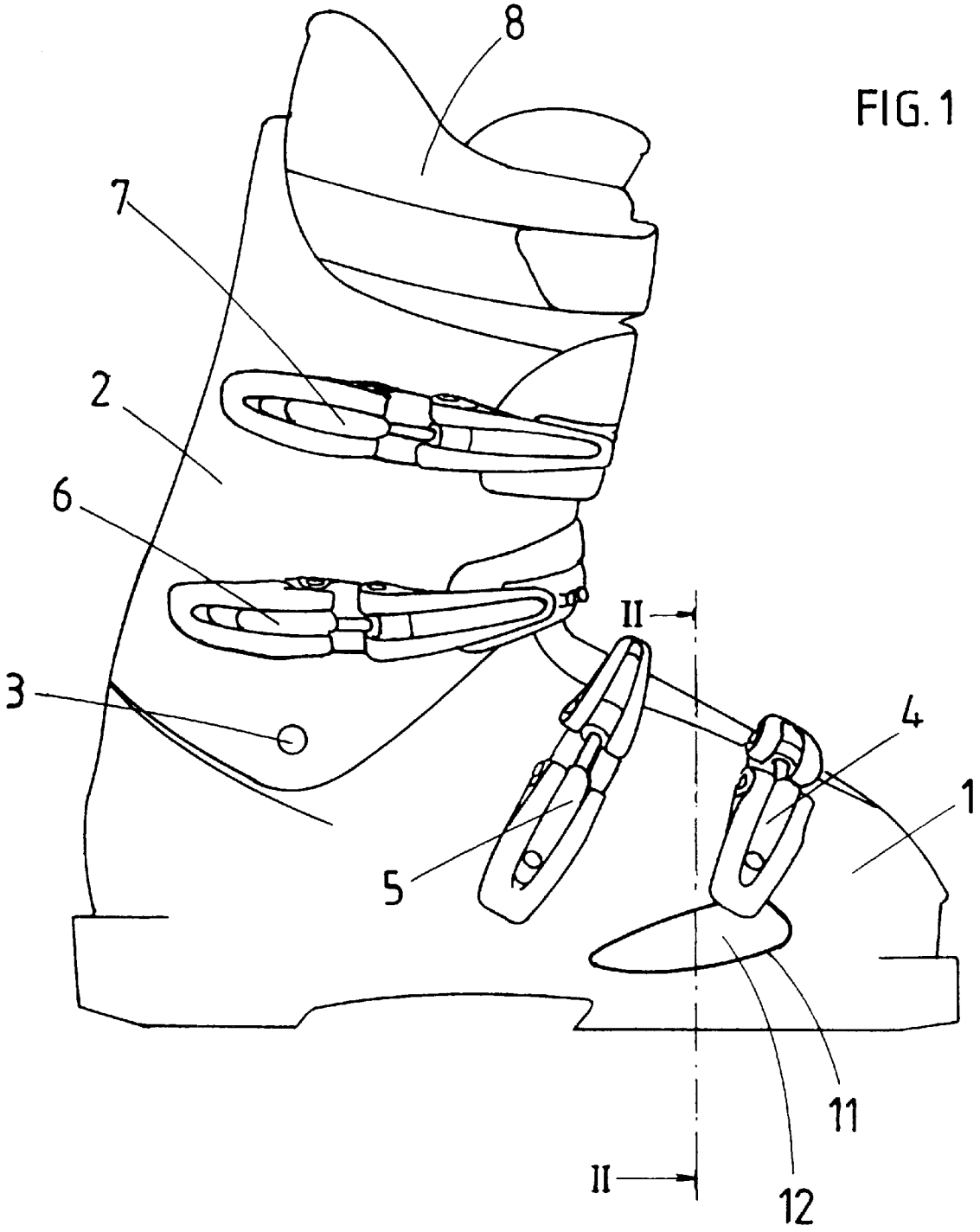
FIG. 1 represents a ski boot seen from the outside of the foot.

The ski boot represented in FIG. 1 consists of a shell 1, referred to as a variable-volume shell and intended to surround the foot and the ankle, and a cuff 2 which is articulated to the shell 1 at a point 3 located in the malleolar region, this cuff 2 being intended to surround the lower leg. According to a well-known design, this boot is provided with two tightening buckles 4 and 5 for tightening the shell 1, and two buckles 6 and 7 for tightening the cuff 2. A comfort inner boot 8 is also shown.

As can be seen in FIG. 2, the shell 1 is made of two layers of plastic 1*a* and 1*b* which are combined by a dual injection or multi-injection process, or alternatively by adhesive bonding or another equivalent process. The plastics used are preferably polyurethane. The layer 1*a,* located on the inside the shell, is made of a plastic whose elasticity is substantially greater than the elasticity of the outer part 1*b,* which includes the sole 9 and the upper flap 10 of the shell which is made exclusively of the harder plastic.

On the outside of the boot, the outer part 1*b* of the shell has a cutout 11 which is positioned so as to surround a zone of the shell located facing the metatarsophalangeal joint of the foot. This cutout 11 delimits a zone 12 in which only the less rigid plastic 1*a* is found. The flexibility of the plastic 1*a* is such that the zone 12 can deform slightly under the pressure of the metatarsophalangeal joint of the foot, so as to substantially reduce the pressure on this joint, and consequently prevent the onset of pain at this location.

The plastic of the layer 1*b* has a hardness of between 58 and 60 shD, for example 62 shD, while the layer 1*a* has a hardness of between 45 shD and 55 shD, for example 54 shD.

The extent of the zone 12 may vary to some degree, but this extent should not be too great so as not to compromise the overall rigidity of the front end of the shell.

Although the shell has been represented only with the cutout 11, it could have other zones of the same type with a view to lightening the shell as envisaged in the prior art.

In a second embodiment of the invention, the shell 1 is made of a single layer of plastic, and has a cutout 11 similar to that in the first embodiment described above. This cutout delimits a zone in which a plastic element 13 is found which is less rigid than the rest of the shell, said element 13 being fixed to the comfort inner boot 8 itself, rather than to the shell 1, as in the first embodiment. The flexibility of this less rigid plastic element 13 also allows a slight deformation under the pressure of the metatarsophalangeal joint. Further, leaktightness of the shell 1 is ensured when tightening the boot on the foot.

Various types of stacks of flexible and rigid materials may be envisaged, and in particular the flexible material could be provided only in the zone 12. For example, the flexible material could lie in continuation of the rigid material, or even outside it.

Other materials, for example textile materials or elastomers, could also be provided in the zone 12.

In addition, the less rigid plastic element 13 may surround the inner boot 8 at least partially.

The embodiments described were presented by way of example, and the application of the invention is not limited to ski boots: the principle of the invention may equally well be applied to other boots, for example skate boots, which have a relatively rigid shell that creates problems similar to those encountered with ski boots.

What is claimed is:

1. A boot for gliding sports having a plastic shell (1) and an inner boot (8), said shell having at least one zone which is less rigid than the rest of the shell, wherein the less rigid zone (12) is a localized, relatively flexible zone on the side of the shell corresponding to the outside and/or inside of a wearer's foot, so as to face the metatarsophalangeal joint of the foot, wherein the shell is made of two plastics each having inside and outside surfaces, and having different rigidities, said flexible zone (12) being made exclusively of the less rigid plastic **(1*a*), and wherein the more rigid plastic (1*b*) and the less rigid plastic (1*a*) are inside and outside layers of the shell, and each flexible zone (12) is defined by a localized cutout (11)** in the more rigid plastic and wherein the layer of less rigid plastic spans the cutout and is bonded to an inside surface of the shell in such a manner that it comprises a continuous inner layer of the shell.

2. The boot as claimed in claim 1, wherein the less rigid plastic **(1*a*, 13)** has a hardness of between 45 and 55 shD.

* * * * *